US010231319B2

(12) United States Patent
Chitta et al.

(10) Patent No.: US 10,231,319 B2
(45) **Date of Patent: *Mar. 12, 2019**

(54) METHODS AND SYSTEMS FOR CONTROLLING AN ELECTRICAL LOAD

(71) Applicant: Lutron Electronics Co., Inc., Coopersburg, PA (US)

(72) Inventors: Venkatesh Chitta, Center Valley, PA (US); Russell L. MacAdam, Coopersburg, PA (US); Matthew R. Zartman, Bethlehem, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 67 days.

This patent is subject to a terminal disclaimer.

(21) Appl. No.: 15/969,255

(22) Filed: May 2, 2018

(65) Prior Publication Data

US 2018/0255629 A1 Sep. 6, 2018

Related U.S. Application Data

(63) Continuation of application No. 15/258,961, filed on Sep. 7, 2016, now Pat. No. 10,004,131, which is a continuation of application No. 13/777,753, filed on Feb. 26, 2013, now Pat. No. 9,462,660.

(51) Int. Cl.
*H05B 41/298* (2006.01)
*H05B 41/30* (2006.01)
(Continued)

(52) U.S. Cl.
CPC ..... *H05B 41/39* (2013.01); *H05B 33/0809* (2013.01); *H05B 33/0845* (2013.01);
(Continued)

(58) Field of Classification Search
CPC .. H05B 41/2925; H05B 41/298; H05B 41/30; H05B 41/36; H05B 41/39; H05B 41/392;
(Continued)

(56) References Cited

U.S. PATENT DOCUMENTS 3,488,573 A 1/1970 Cavigelli et al.
4,001,637 A 1/1977 Gray
(Continued)

FOREIGN PATENT DOCUMENTS

DE 102007047142 A1 4/2009
WO WO 1997/029618 A1 8/1997

*Primary Examiner* — Wei Chan
(74) *Attorney, Agent, or Firm* — Condo Roccia Koptiw LLP

(57) ABSTRACT

An electronic dimming ballast or light emitting diode (LED) driver for driving a gas discharge lamp or LED lamp may be operable to control the lamp to avoid flickering and flashing of the lamp during low temperature or low mercury conditions. Such a ballast or driver may include a control circuit that is operable to adjust the intensity of the lamp. Adjusting the intensity of the lamp may include decreasing the intensity of the lamp. The control circuit may be operable to stop adjustment of the intensity of the lamp if a magnitude of the lamp voltage across the lamp is greater than an upper threshold, and subsequently begin to adjust the intensity of the lamp when the lamp voltage across the lamp is less than a lower threshold. Subsequently beginning to adjust the intensity of the lamp may include subsequently decreasing the intensity of the lamp.

18 Claims, 8 Drawing Sheets

(51) Int. Cl.

| | |
|---|---|
| ***H05B 41/36*** | (2006.01) |
| ***H05B 41/39*** | (2006.01) |
| ***H05B 33/08*** | (2006.01) |
| ***H05B 41/392*** | (2006.01) |
| ***H05B 41/38*** | (2006.01) |
| ***H05B 37/02*** | (2006.01) |

(52) U.S. Cl.
CPC ..... *H05B 37/02* (2013.01); *H05B 41/38* (2013.01); *H05B 41/392* (2013.01)

(58) Field of Classification Search
CPC ..... H05B 41/3928; H05B 33/0827; H05B 33/0833; H05B 33/0857; H05B 33/0884; H05B 33/089; H05B 33/0896; H05B 35/00
USPC ..... 315/291, 224, 209 R, 307
See application file for complete search history.

(56) References Cited

U.S. PATENT DOCUMENTS

| | | | | |
|---|---|---|---|---|
| 4,467,386 | A | 8/1984 | Wasson | |
| 4,580,088 | A | 4/1986 | Bloomer | |
| 4,675,777 | A | 6/1987 | Watrous | |
| 4,866,347 | A | 9/1989 | Nuckolls et al. | |
| 5,850,127 | A * | 12/1998 | Zhu | H05B 41/2988 315/307 |
| 5,945,788 | A | 8/1999 | Li et al. | |
| 5,969,483 | A | 10/1999 | Li et al. | |
| 6,078,143 | A | 6/2000 | Nerone | |
| 6,111,368 | A | 8/2000 | Luchaco | |
| 6,133,697 | A | 10/2000 | Nagai et al. | |
| 6,452,344 | B1 | 9/2002 | MacAdam et al. | |
| 6,982,528 | B2 | 1/2006 | Cottongim et al. | |
| 7,061,191 | B2 | 6/2006 | Chitta | |
| 7,321,202 | B2 | 1/2008 | Chitta | |
| 7,436,131 | B2 | 10/2008 | Cottingim et al. | |
| 7,489,090 | B2 | 2/2009 | Taipale | |
| 7,528,554 | B2 | 5/2009 | Chitta et al. | |
| 7,675,250 | B2 | 3/2010 | Chitta et al. | |
| 7,764,479 | B2 | 7/2010 | Chitta et al. | |
| 7,830,093 | B2 | 11/2010 | Chitta | |
| 9,414,472 | B2 | 8/2016 | Gawrys | |
| 9,736,911 | B2 | 8/2017 | Taipale et al. | |
| 2005/0099142 | A1 | 5/2005 | Cottongim et al. | |
| 2006/0061304 | A1 | 3/2006 | Cho et al. | |
| 2008/0018263 | A1 | 1/2008 | Ohta et al. | |
| 2010/0013393 | A1 | 1/2010 | Onishi et al. | |
| 2011/0241561 | A1 | 10/2011 | Chitta et al. | |

* cited by examiner

METHODS AND SYSTEMS FOR CONTROLLING AN ELECTRICAL LOAD

CROSS-REFERENCE TO RELATED APPLICATIONS

This application is a continuation of U.S. Non-Provisional application Ser. No. 15/258,961, filed on Sep. 7, 2016, which is a continuation of U.S. Non-Provisional application Ser. No. 13/777,753, filed on Feb. 26, 2013, now U.S. Pat. No. 9,462,660, issued on Oct. 4, 2016, the contents of which are hereby incorporated by reference herein.

BACKGROUND

In order to reduce energy consumption of artificial illumination sources, the use of high efficiency light sources is increasing, while the use of low efficiency light sources is decreasing. Examples of high efficiency light sources may include gas discharge lamps (e.g., compact fluorescent lamps), phosphor based lamps, high intensity discharge (HID) lamps, light emitting diode (LED) light sources, and other types of high-efficacy light sources. Examples of low efficiency light sources may include incandescent lamps, halogen lamps, and other low efficacy light sources.

Lighting control devices, such as dimmer switches, for example, may allow for controlling the amount of power delivered from a power source to a lighting load, such that the intensity of the lighting load may be dimmed from a high-end (e.g., maximum) intensity to a low end (e.g., minimum) intensity. Both high efficiency and low efficiency light sources may be dimmed, but the dimming characteristics of these two types of light sources may differ.

Due to the increased desire to use more high-efficiency light sources, fluorescent lamps, for example, are now being installed outdoors where the lamps may be subject to low operating temperatures. A ballast may be required to regulate the current conducted through a fluorescent lamp to properly illuminate the lamp. Fluorescent lamps may not operate correctly and may flicker if the lamps are dimmed in cold ambient temperatures. This may be intensified if the lamp has a low mercury concentration. As the lamp is dimmed towards the low-end intensity, the magnitude of a lamp voltage required to drive the lamp may increase. As the temperature of the lamp decreases, the magnitude of the lamp voltage required to drive the lamp may further increase. The increase in lamp voltage required to drive the lamp may cause unnecessary stress on the electrical components of the ballast, as well as instability in the intensity of the lamp near the low end intensity of the lamp, which may consequently produce visible flickering or flashing of the lamp. A load control device for high efficiency light sources that may stably dim a light source to low intensities without flicker in low temperature and/or low mercury conditions may be desired.

FIG. 1 is a perspective view of an example gas discharge lamp fixture 100. The fixture 100 may include a ballast 102, lamp sockets 104, and a housing 106. The ballast 102 and the sockets 104 may be fixed to the housing 106. The lamp sockets 104 may be sized and situated within the housing 106 to hold the lamps 108. The ballast 102 may have wires 110 to connect the ballast 102 to the sockets 104 for driving the lamps 108 and for providing heating current.

FIGS. 2A and 2B show example exterior lamp fixtures 202, 210. These fixtures, typically made of metal or plastic, are particularly suited for outdoor use. In FIG. 2A, the exterior fixture 202 includes a housing 204 and a translucent cover 206. The housing 204 may be mounted to an exterior ceiling or wall. Gas discharge lamps 208 may be attached to the housing via lamp sockets (not shown). A ballast (not shown) may be contained in the housing, as well. Similarly, the fixture 210 shown in FIG. 2B includes a housing 212 and a translucent cover 214. This fixture 210 is shown with a compact fluorescent lamp 216. The compact fluorescent lamp 216 may include an internal ballast contained in the base structure of the lamp. In both examples, the covers 206, 214 may protect the lamps 208, 216 and the ballasts from weather, including water and humidity. However, the lamps and the ballasts may still be subject to the cold ambient temperatures and the corresponding effects described above.

Additional background may be found in commonly assigned U.S. patent application Ser. No. 12/955,988, filed Nov. 30, 2010, entitled METHOD OF CONTROLLING AN ELECTRONIC DIMMING BALLAST DURING LOW TEMPERATURE CONDITIONS, and commonly assigned U.S. patent application Ser. No. 13/629,903 filed Sep. 28, 2012, entitled FILAMENT MISWIRE PROTECTION IN AN ELECTRONIC DIMMING BALLAST, the entire disclosures of each of which are hereby incorporated by reference.

SUMMARY

An electronic dimming ballast for driving a gas discharge lamp may be operable to control the lamp to avoid flickering and flashing of the lamp during low temperature or low mercury conditions. Such a ballast may include a control circuit that is operable to adjust the intensity of the lamp. Adjusting the intensity of the lamp may include decreasing the intensity of the lamp. The control circuit may be operable to stop adjustment of the intensity of the lamp if a magnitude of the lamp voltage across the lamp is greater than an upper threshold, and subsequently begin to adjust the intensity of the lamp when the lamp voltage across the lamp is less than a lower threshold. Subsequently beginning to adjust the intensity of the lamp may include subsequently decreasing the intensity of the lamp. The control circuit may be operable to determine a magnitude of the lamp voltage across the lamp.

The control circuit may be operable to decrease the intensity of the lamp at a first rate and subsequently decrease the intensity of the lamp at a second rate. The second rate may be slower than the first rate. The magnitude of the lamp voltage may depend on a lamp temperature of the lamp and/or a mercury concentration of the lamp. The control circuit may be further operable to receive a lamp voltage control signal representative of the magnitude of a lamp voltage across the lamp.

Such a ballast may further include an inverter circuit for receiving a DC bus voltage and for generating a high-frequency output voltage, and a resonant tank circuit for receiving the high-frequency output voltage and generating a sinusoidal voltage for driving the lamp.

A method for driving a gas discharge lamp may include adjusting an intensity of the lamp, determining a magnitude of a lamp voltage across the lamp, stopping adjustment of the intensity of the lamp if the magnitude of the lamp voltage across the lamp is greater than an upper threshold, and subsequently beginning to adjust the intensity of the lamp when the lamp voltage across the lamp is less than a lower threshold.

An electronic dimming ballast for controlling the intensity of a gas discharge lamp may include a control circuit that may be operable to decrease an intensity of the lamp at a first rate, determine that a magnitude of a lamp voltage across the lamp is above an upper threshold, increase the intensity of the lamp, determine that the magnitude of the lamp voltage across the lamp is below a lower threshold, and decrease the intensity of the lamp at a second rate until the magnitude of the lamp voltage across the lamp is above the upper threshold or the intensity of the lamp is at a target intensity level. The intensity of the lamp may be increased such that the magnitude of the lamp voltage across the lamp is equal to or below the upper threshold. The intensity of the lamp may be periodically increased by a predetermined amount. The target intensity level may be the minimum intensity of the lamp.

A method for driving a gas discharge lamp may include decreasing an intensity of the lamp at a first rate, determining that a magnitude of a lamp voltage across the lamp is above an upper threshold, increasing the intensity of the lamp, determining that the magnitude of the lamp voltage across the lamp is below a lower threshold, and decreasing the intensity of the lamp at a second rate until the magnitude of the lamp voltage across the lamp is above the upper threshold or the intensity of the lamp is at a target intensity level.

An electronic dimming ballast for controlling an amount of power delivered to an electrical load may include a control circuit. The control circuit may be operable to adjust a first magnitude of a first operating characteristic of the electrical load, measure a second magnitude of a second operating characteristic of the electrical load, the second operating characteristic different than the first operating characteristic, stop adjustment of the first magnitude of the first operating characteristic of the electrical load if the second magnitude of the second operating characteristic crosses a first threshold, and subsequently begin to adjust the first magnitude of the first operating characteristic of the electrical load when the second magnitude of the second operating characteristic crosses a second threshold. The first operating characteristic may include a load current conducted through the electrical load. The second operating characteristic may include a load voltage produced across the electrical load.

The control circuit may be operable to stop adjustment of a magnitude of the load current if a magnitude of the load voltage is greater than the first threshold. The control circuit may be operable to decrease the magnitude of the load current conducted through the load. The control circuit may be operable to subsequently decrease the magnitude of the load current when the magnitude of the load voltage is less than the second threshold. The electrical load may include a gas discharge lamp.

The control circuit may be operable to increase the magnitude of the load current conducted through the load. The control circuit may be operable to subsequently increase the magnitude of the load current when the magnitude of the load voltage is less than the second threshold. The electrical load may include an LED light source.

A method for controlling an amount of power delivered to an electrical load may include adjusting a first magnitude of a first operating characteristic of the electrical load, measuring a second magnitude of a second operating characteristic of the electrical load, the second operating characteristic different than the first operating characteristic, stopping adjustment of the first magnitude of the first operating characteristic of the electrical load if the second magnitude of the second operating characteristic crosses a first threshold, and subsequently beginning to adjust the first magnitude of the first operating characteristic of the electrical load when the second magnitude of the second operating characteristic crosses a second threshold.

DETAILED DESCRIPTION

Figure 1:
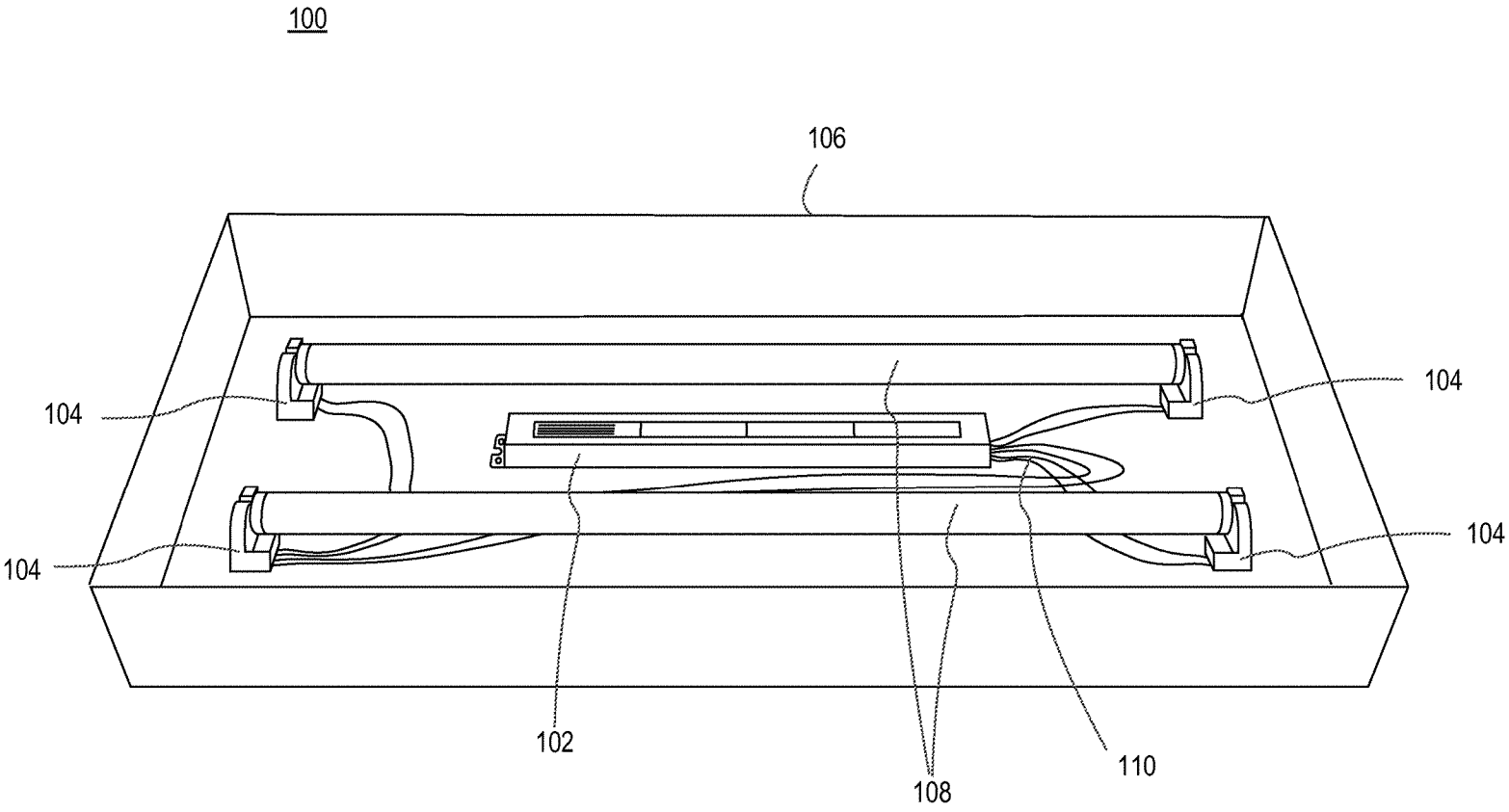
FIG. 1 is a perspective view of an example gas discharge lamp fixture.
Figure 2A:
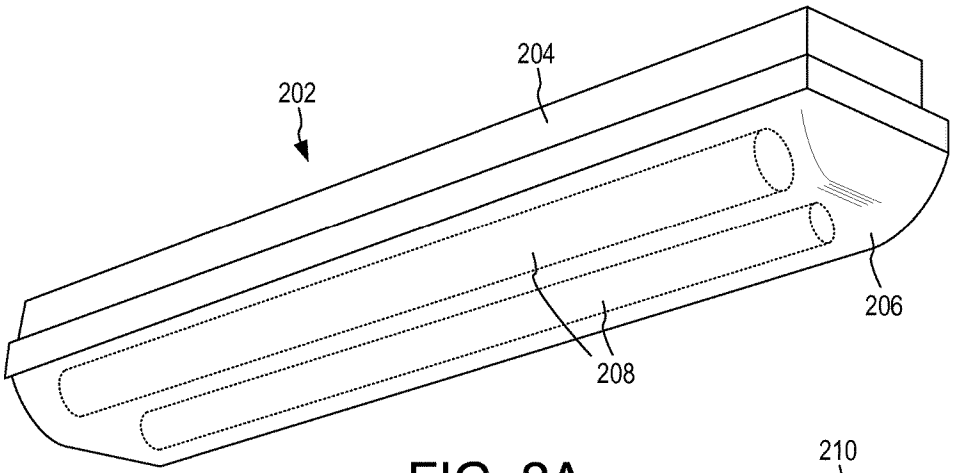
FIGS. 2A and 2B are perspective views of example outdoor fixtures.
Figure 2B:
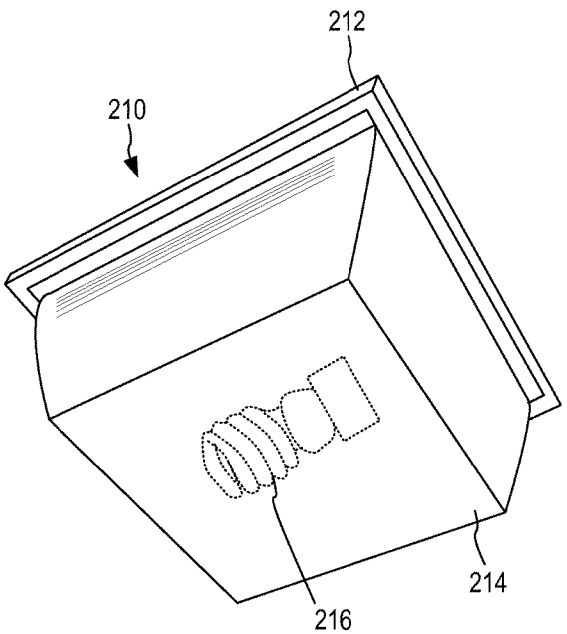
Figure 3:
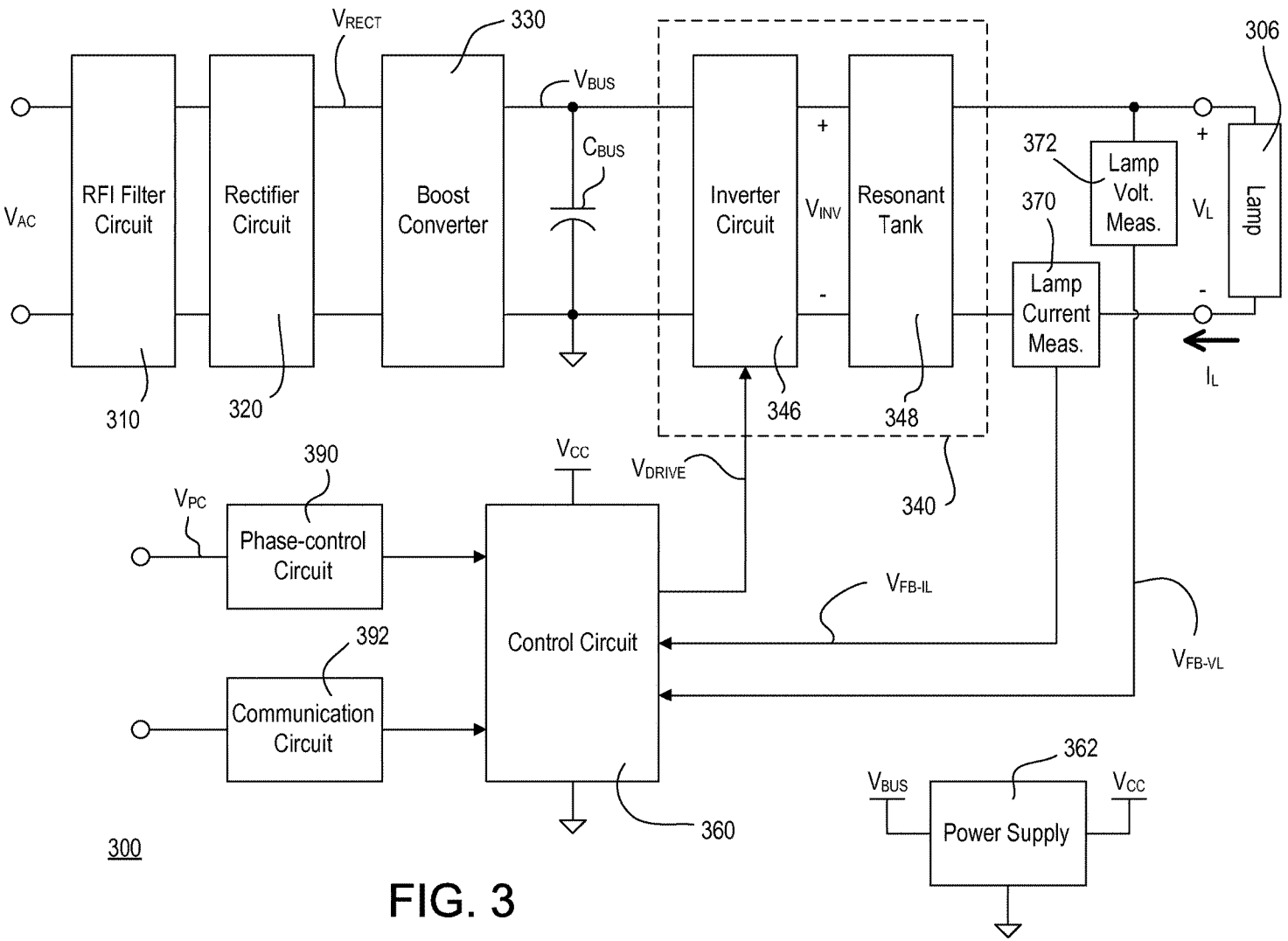
FIG. 3 is a simplified block diagram of an example of an electronic dimming ballast.

FIG. 3 is a block diagram of an example of an electronic dimming ballast 300. The ballast 300 may include a hot terminal H and a neutral terminal N that are adapted to be coupled to an alternating-current (AC) power source (not shown) for receiving an AC mains line voltage $V_{AC}$. The ballast 300 may be adapted to be coupled between the AC power source and a gas discharge lamp 306 (e.g., a fluorescent lamp). The ballast 300 may be operable to control the amount of power delivered to the lamp and thus the intensity of the lamp 306. The ballast 300 may include an RFI (radio frequency interference) filter circuit 310 for minimizing the noise provided on the AC mains, and a rectifier circuit 320 for generating a rectified voltage $V_{RECT}$ from the AC mains line voltage $V_{AC}$. The ballast 300 may include a boost converter 330 for generating a direct-current (DC) bus voltage $V_{BUS}$ across a bus capacitor $C_{BUS}$. The DC bus voltage $V_{BUS}$ may have a magnitude (e.g., approximately 465 V) that is greater than the peak magnitude $V_{PK}$ of the AC mains line voltage $V_{AC}$ (e.g., approximately 170 V). The boost converter 330 may operate as a power-factor correction (PFC) circuit for improving the power factor of the ballast 300. The ballast 300 may include a load control circuit 340 that includes an inverter circuit 346 and a resonant tank circuit 348. The inverter circuit 346 may convert the DC bus voltage $V_{BUS}$ to a high-frequency AC voltage. The resonant tank circuit 348 may couple the high-frequency AC voltage generated by the inverter circuit to filaments of the lamp 306.

The ballast 300 may include a control circuit 360 for controlling a present intensity $L_{PRES}$ of the lamp 306 to a target intensity $L_{TARGET}$ between a low-end (e.g., minimum) intensity $L_{LE}$ (e.g., 1%) and a high-end (e.g., maximum) intensity $L_{HE}$ (e.g., 100%). The control circuit 360 may include a microprocessor, a microcontroller, a programmable logic device (PLD), an application specific integrated circuit (ASIC), or any suitable type of controller or control circuit. The control circuit 360 may be coupled to the inverter circuit 346 and provide a drive control signal $V_{DRIVE}$ to the inverter circuit for controlling the magnitude of a lamp voltage $V_L$ generated across the lamp 306 and a lamp current $I_L$ conducted through the lamp. The present intensity $L_{PRES}$ of the lamp 306 may be proportional to the magnitude of the lamp current $I_L$ that is presently being conducted through the lamp. The control circuit 360 may be operable to turn the lamp 306 on and off, and adjust (e.g., dim) the present intensity $L_{PRES}$ of the lamp. The control circuit 360 may receive a lamp current feedback signal $V_{FB-IL}$, which may be generated by a lamp current measurement circuit 370 and is representative of the magnitude of the lamp current $I_L$. The control circuit 360 may execute a current control routine to adjust the present intensity $L_{PRES}$ of the lamp 306 by controlling the magnitude of the lamp current $I_L$ supplied to (e.g., and conducted through) the lamp.

The control circuit 360 may receive a lamp voltage feedback signal $V_{FB-VL}$, which may be generated by a lamp voltage measurement circuit 372, and is representative of the magnitude of the lamp voltage $V_L$. The control circuit 360 may infer a lamp temperature $T_L$ of the fluorescent lamp 306 from the magnitude of the lamp voltage $V_L$. Since the lamp voltage $V_L$ may depend on the lamp temperature $T_L$ of the fluorescent lamp 306, the lamp voltage feedback signal $V_{FB-VL}$ generated by the lamp voltage measurement circuit 372 may be representative of the lamp temperature $T_L$ of the fluorescent lamp 306. The ballast 300 may include a power supply 362, which may receive the bus voltage $V_{BUS}$ and generate a DC supply voltage $V_{CC}$ (e.g., approximately five volts) for powering the control circuit 360 and other low-voltage circuitry of the ballast.

The ballast 300 may include a phase-control circuit 390 for receiving a phase-control voltage $V_{PC}$ (e.g., a forward or reverse phase-control signal) from a standard phase-control dimmer (not shown). The control circuit 360 may be coupled to the phase-control circuit 390, such that the control circuit 360 may be operable to determine the target intensity $L_{TARGET}$ and a corresponding target lamp current $I_{TARGET}$ for the lamp 306 from the phase-control voltage $V_{PC}$. The ballast 300 may include a communication circuit 392, which may be coupled to the control circuit 360 and allows the ballast to communicate (e.g., transmit and receive digital messages) with the other control devices on a communication link (not shown), e.g., a wired communication link or a wireless communication link, such as a radio-frequency (RF) or an infrared (IR) communication link. Examples of ballasts having communication circuits are described in greater detail in commonly-assigned U.S. Pat. No. 7,489,090, issued Feb. 10, 2009, entitled ELECTRONIC BALLAST HAVING ADAPTIVE FREQUENCY SHIFTING; U.S. Pat. No. 7,528,554, issued May 5, 2009, entitled ELECTRONIC BALLAST HAVING A BOOST CONVERTER WITH AN IMPROVED RANGE OF OUTPUT POWER; and U.S. Pat. No. 7,764,479, issued Jul. 27, 2010, entitled COMMUNICATION CIRCUIT FOR A DIGITAL ELECTRONIC DIMMING BALLAST, the entire disclosures of which are hereby incorporated by reference. The ballasts 312 may be two-wire ballasts operable to receive power and communication (e.g., digital messages) via two power lines from the digital ballast controller 310, for example, as described in greater detail in U.S. patent application Ser. No. 13/359,722, filed Jan. 27, 2012, entitled DIGITAL LOAD CONTROL SYSTEM PROVIDING POWER AND COMMUNICATION VIA EXISTING POWER WIRING, the entire disclosure of which is hereby incorporated by reference.

As disclosed herein, the control circuit 360 may use a current-control lockout procedure to control the present intensity $L_{PRES}$ of the fluorescent lamp 306 (e.g., via the lamp current $I_L$ that may be conducted through the lamp) throughout the operation of a ballast 300. Cold lamps and/or lamps with low mercury concentration may require high (e.g., extremely high) voltages at low currents to operate. For example, cold lamps and/or lamps with low mercury concentration may require twice as much voltage (e.g., approximately 360 volts) to operate at low currents than lamps operating under normal conditions at low currents, which may require, for example, approximately 180 volts. Therefore, lamps that are cold and/or have low mercury concentration may require higher voltages to operate at lower intensity levels (e.g., which correspond to lower operating currents). Potential issues relating to operating lamps at high voltages are described herein (e.g., flickering). The current-control lockout procedure disclosed herein may deter the ballast 300 from operating the lamp 306 at high voltages by controlling the present intensity $L_{PRES}$ of the lamp 306 (e.g., via the lamp current $I_L$ that is conducted through the lamp). As the lamp 306 heats up and/or more mercury is released, the lamp voltage $V_L$ required for operation at low-end intensities may drop. As the magnitude of the lamp voltage $V_L$ required for operation at low-end is reduced, the current-control lockout procedure may allow the lamp 306 to reach its actual low-end intensity or current level. The current-control lockout procedure described herein may be incorporated into an electronic dimming ballast, such as via a control circuit as described in connection with FIG. 3.

The control circuit 360 may compare the magnitude of the lamp voltage $V_L$ to an upper voltage threshold $V_{TH-UP}$ and a lower voltage threshold $V_{TH-LOW}$. The upper voltage threshold $V_{TH-UP}$ may represent an upper limit of the lamp voltage $V_L$ below which the lamp 306 exhibits consistent and desired performance. For example, if the lamp voltage $V_L$ exceeds the upper voltage threshold $V_{TH-UP}$, the lamp 306 may flicker or otherwise exhibit less than ideal performance. The lower voltage threshold $V_{TH-LOW}$ may represent a guideline that may be used to determine when the magnitude of the lamp voltage $V_L$ is sufficiently low that dimming of the lamp 306 may occur without hampering the desired performance of the lamp. The upper voltage threshold $V_{TH-UP}$ and the lower voltage threshold $V_{TH-LOW}$ may be fixed or adjustable. The upper voltage threshold $V_{TH-UP}$ and the lower voltage threshold $V_{TH-LOW}$ may be configured specifically for the ballast 300 and/or type of lamp being controlled. If the magnitude of the lamp voltage $V_L$ exceeds the upper voltage threshold $V_{TH-UP}$, the control circuit 360 may be operable to lockout the current control routine to freeze (e.g., stop adjustment of) the lamp current $I_L$ until the lamp 306 warms up and the magnitude of the lamp voltage drops below the lower voltage threshold $V_{TH-LOW}$, after which the control circuit may begin to adjust the lamp current $I_L$ once again.

Figure 4:
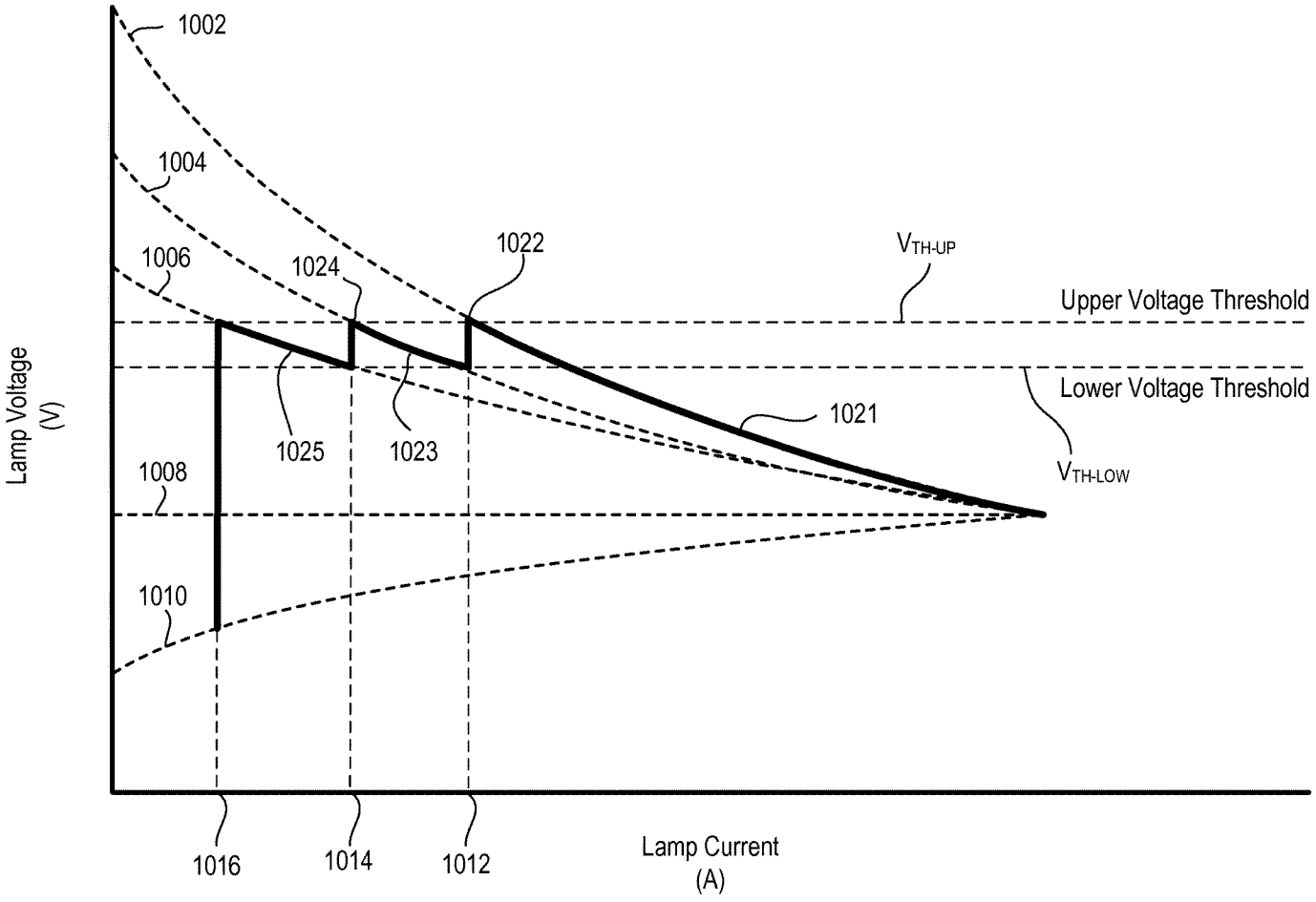
FIG. 4 is a graph illustrating an example of the relationship between lamp current and lamp voltage during an adaptive low-end procedure.

FIG. 4 is a graph showing an example relationship between the lamp current $I_L$ and the lamp voltage $V_L$ during a current-control lockout procedure executed by a control circuit of a ballast (e.g., the control circuit 360 of the ballast 300 of FIG. 3). The example scenario of FIG. 4 may be where a control circuit is attempting to control a cold and/or mercury depleted lamp to the low-end intensity $L_{LE}$ (e.g., the minimum intensity level). An example scenario may include the following. At 1021, when first struck and attempting to dim to low-end intensity $L_{LE}$, the lamp 306 may be operating with an I-V (e.g., current-voltage) curve 1002. The control circuit 360 may adjust the present intensity $L_{PRES}$ of the lamp 306 by adjusting the lamp current $I_L$ at a first rate (e.g., an initial or pre-lockout rate). For example, the control circuit 360 may decrease the present intensity $L_{PRES}$ towards the target intensity $L_{TARGET}$, which may be the low-end intensity $L_{LE}$ of the lamp 306 (e.g., at lamp current level 1016).

At 1022, if the magnitude of the lamp voltage $V_L$ is equal to or exceeds the upper voltage threshold $V_{TH-UP}$ (e.g., at lamp current level 1012), then the control circuit 360 may stop adjusting the lamp current $I_L$ and maintain the magnitude of the lamp current constant for a period of time. As the lamp 306 heats up and/or more mercury is released, the I-V curve may begin to flatten out (e.g., as shown by the progression from I-V curve 1002, to I-V curve 1004, to I-V curve 1006, to I-V curve 1008, to I-V curve 1010). After a period of time while the lamp current $I_L$ is maintained constant, the I-V curve may begin to flatten out and/or reach its characteristic shape, for example, by leveling out from the I-V curve 1002 to the I-V curve 1004. If the I-V curve adjusts such that the magnitude of the lamp voltage $V_L$ drops below the lower voltage threshold $V_{TH-LOW}$, the control circuit 360 may once again begin decreasing the lamp current $I_L$ towards the target lamp current $I_{TARGET}$ (e.g., at 1023 as shown in FIG. 4), for example, at a second rate (e.g., a post-lockout rate) that may be slower than the first rate.

If the magnitude of the lamp voltage $V_L$ overshoots the upper voltage threshold $V_{TH-UP}$ as the magnitude of the lamp current $I_L$ is decreasing (e.g., at 1022 in FIG. 4), the control circuit 360 may increase the magnitude of the lamp current at a predetermined rate or by a predetermined amount, for example, until the magnitude of the lamp voltage is once again below the upper voltage threshold $V_{TH-UP}$. The magnitude of the lamp current $I_L$ may be periodically increased by the predetermined amount (e.g., every 104 μsec). After the magnitude of the lamp voltage $V_L$ is below the upper voltage threshold $V_{TH-UP}$, the control circuit 360 may then stop adjusting the lamp current $I_L$. The control circuit 360 may anticipate that the magnitude of the lamp voltage $V_L$ will meet or exceed the upper voltage threshold $V_{TH-UP}$ and adjust accordingly (e.g., stop, reduce the rate at which the intensity of the lamp may be decreasing, etc.), for example, such that the magnitude of the lamp voltage may not exceed the upper voltage threshold.

At 1024, if the magnitude of the lamp voltage $V_L$ meets or exceeds the upper voltage threshold $V_{TH-UP}$ again, then the control circuit 360 may freeze the target intensity $L_{TARGET}$ of the lamp 306 for a period of time (e.g., as shown at current level 1014) and/or may increase the magnitude of the lamp current $I_L$ at a predetermined rate or by a predetermined amount if there is an overshoot of the lamp voltage $V_L$. This may be a similar process as described above when the lamp current $I_L$ reached current level 1012. For example, the current-control lockout procedure may freeze adjustment of the lamp current $I_L$ and/or may increase the lamp current $I_L$ until the magnitude of the lamp voltage $V_L$ is below the upper voltage threshold $V_{TH-UP}$.

At 1025, if the magnitude of the lamp voltage $V_L$ drops below the lower voltage threshold $V_{TH-LOW}$, then the control circuit 360 may once again begin decreasing the magnitude of the lamp current $I_L$ at the second rate or a third rate that is slower than the second rate. At this point, the I-V curve 1006 may not have settled to its characteristic shape, for example, as represented by I-V curve 1010 in FIG. 4. Even though the I-V curve had yet to reach its characteristic shape, the control circuit 360 may be able to adjust the present intensity $I_{PRES}$ of the lamp 306 (e.g., via adjusting the lamp current $I_L$), such that the lamp reaches the low-end intensity $L_{LE}$.

Although the scenario of FIG. 4 includes two instances of the magnitude of the lamp voltage $V_L$ exceeding the upper voltage threshold $V_{TH-UP}$ (e.g., at lamp current level 1012 and lamp current level 1014), the current-control lockout procedure may be implemented in scenarios where the magnitude of the lamp voltage $V_L$ meets or exceeds the upper voltage level $V_{TH-UP}$ any number of times (e.g., any number greater than or equal to one).

Figure 5A:
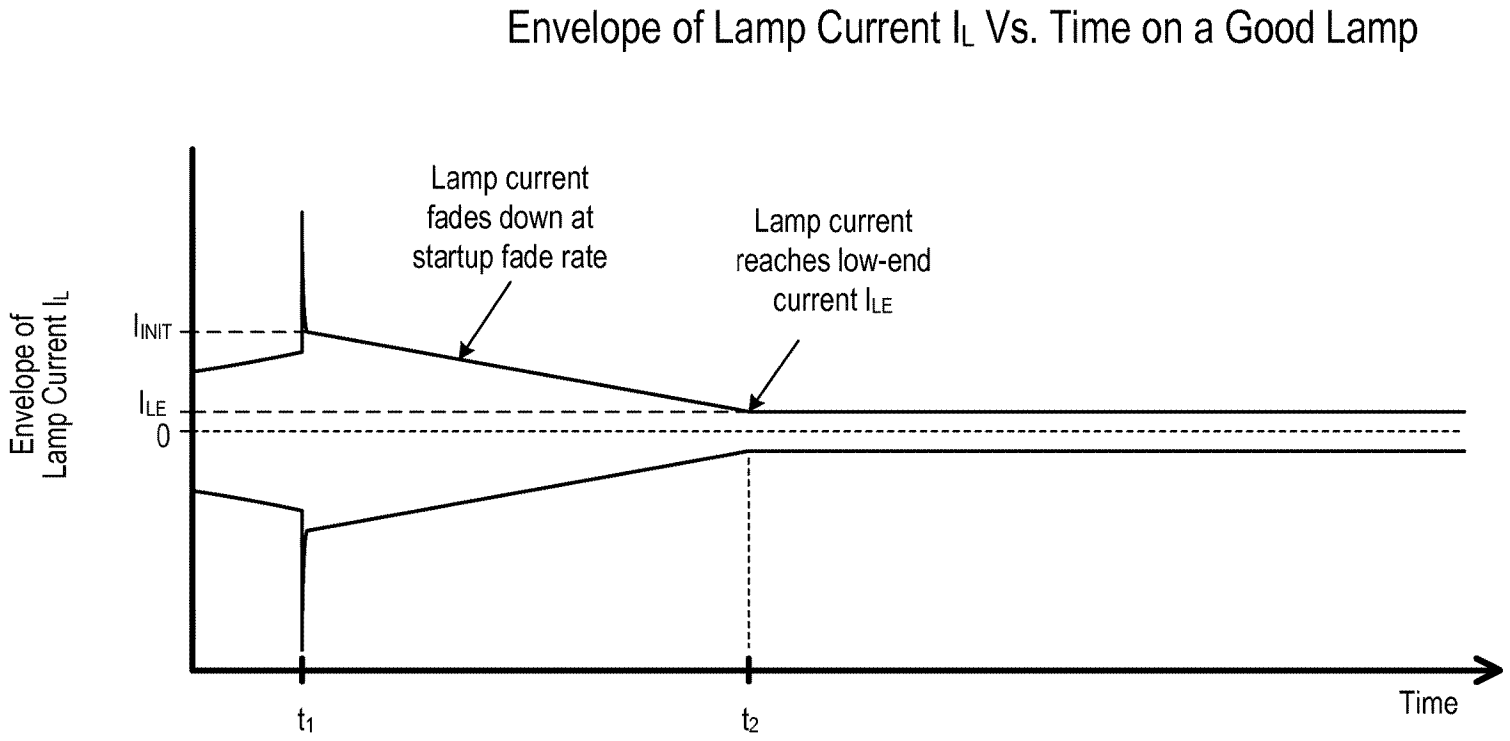
FIG. 5A is an example plot of the magnitude of lamp current with respect to time during a current-control lockout procedure executed by a control circuit of a ballast when the ballast strikes a good lamp.
Figure 5B:
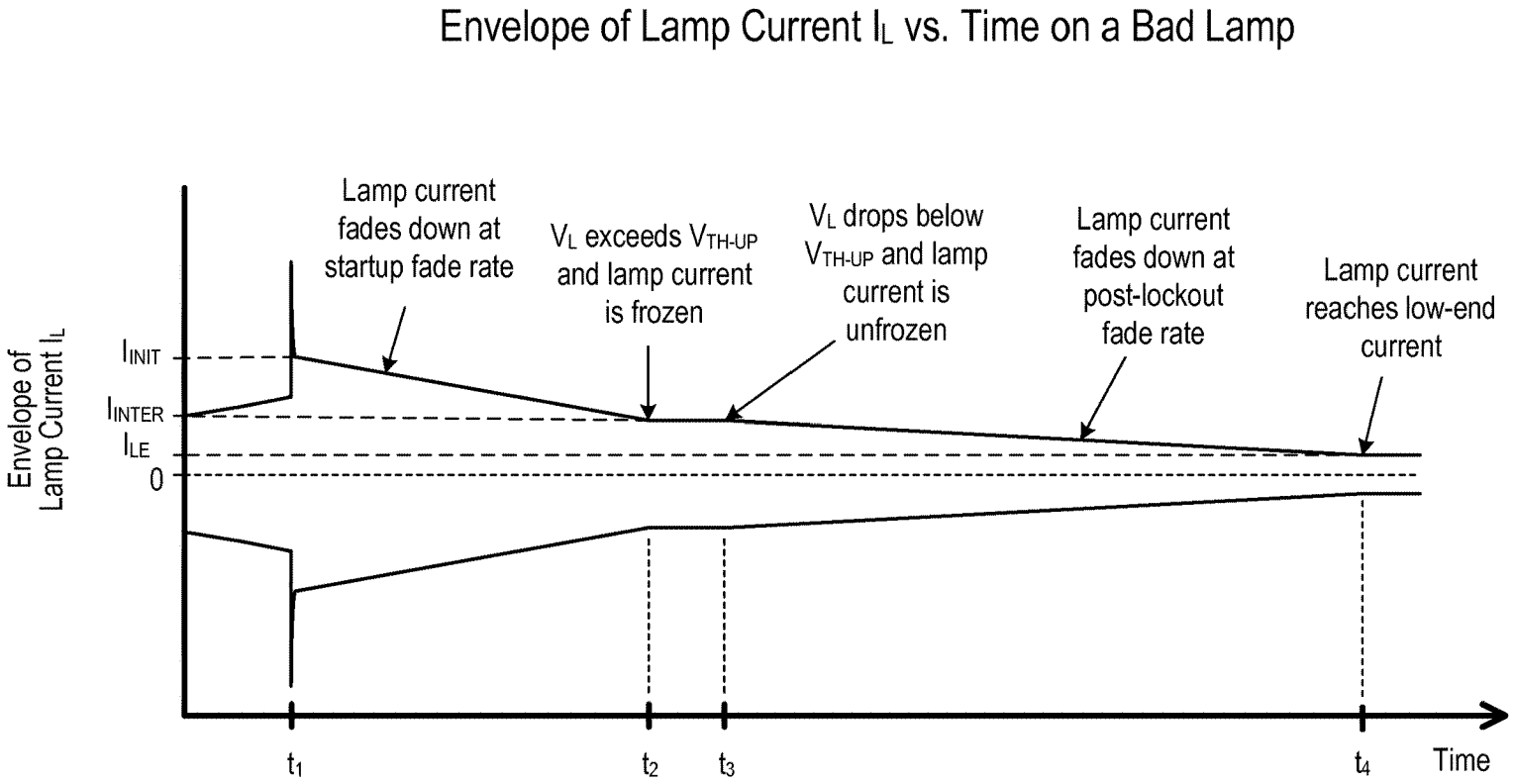
FIG. 5B is an example plot of the magnitude of lamp current with respect to time during a current-control lockout procedure executed by a control circuit of a ballast when the ballast strikes a bad lamp.

FIG. 5A is an example plot of the magnitude of the lamp current $I_L$ with respect to time on a good lamp during a current-control lockout procedure executed by a control circuit of a ballast (e.g., the control circuit 360 of the ballast 300) when the lamp is first turned on to the low-end intensity $L_{LE}$. FIG. 5B is an example plot of the magnitude of the lamp current $I_L$ with respect to time on a bad lamp during a current-control lockout procedure executed by a control circuit of a ballast (e.g., the control circuit 360 of the ballast 300) when the lamp is first turned on to the low-end intensity $L_{LE}$.

After the lamp 306 strikes at time $t_1$, for example as shown in FIG. 5A, the control circuit 360 may control the present intensity $L_{PRES}$ of the lamp 306 on to an initial intensity $L_{INIT}$ (e.g., approximately 15%) and then decrease the present intensity $L_{PRES}$ of the lamp 306 to the target intensity $L_{TARGET}$ at time t2 using the first fade rate (e.g., the initial rate). Specifically, the control circuit 360 is operable to decrease the magnitude of the lamp current $I_L$ of the lamp 306 from an initial current $I_{INIT}$ (e.g., which may correspond to the initial intensity UNIT) to the target current $I_{TARGET}$ (e.g., which may correspond to the target intensity $L_{TARGET}$). For example, the target intensity $L_{TARGET}$ may be the low-end intensity $L_{LE}$ (e.g., approximately 5%) at which the magnitude of the lamp current $I_L$ may be controlled to a low-end current ILE. In addition, the first fade rate may be a constant fade rate (e.g., approximately ⅓% per second) equivalent to approximately 30 seconds from the initial intensity $L_{INIT}$ (e.g., 15%) to the low-end intensity $L_{LE}$ (e.g., approximately 5%). Such a fade rate may be utilized because it may be slow enough that a user may not be able to notice that the lamp 306 is actively dimming. After the magnitude of the lamp current $I_L$ reaches the low-end current ILE at time t2, the control circuit 360 maintains the magnitude of the lamp current $I_L$ constant at the low-end current ILE. Thus, as shown in FIG. 5A, the control circuit 360 may decrease the magnitude of the lamp current $I_L$ to the target current $I_{TARGET}$ at the first fade rate on a good lamp without freezing adjustment of the lamp current $I_L$ (e.g., without the magnitude of the lamp voltage $V_L$ exceeding the upper threshold level $V_{TH-UP}$).

The magnitude of the lamp voltage $V_L$ may be checked (e.g., periodically checked) to determine if the magnitude of the lamp voltage $V_L$ meets or exceeds the upper voltage threshold $V_{TH-UP}$. If at any time (e.g., during a dimming procedure) the magnitude of the lamp voltage $V_L$ meets or exceeds the upper voltage threshold $V_{TH-UP}$, the control circuit 360 may operate to freeze adjustments of the lamp current $I_L$ until the magnitude of the lamp voltage drops below the lower voltage threshold $V_{TH-LOW}$. For example, when the lamp 306 is first struck at time $t_1$ as shown in FIG. 5B, the control circuit 360 may decrease the magnitude of the lamp current $I_L$ from the initial lamp current $I_{INIT}$ at the first rate. When the magnitude of the lamp current $I_L$ drops to an intermediate lamp current $I_{INTER}$ (e.g., which may correspond to a present intensity $L_{PRES}$ of approximately 8%), the magnitude of the lamp voltage $V_L$ may meet or exceed the upper voltage threshold $V_{TH-UP}$. When the magnitude of the lamp voltage $V_L$ meets or exceeds the upper voltage threshold $V_{TH-UP}$ at time t2 in FIG. 5B, the control circuit 360 stops decreasing the present intensity $L_{PRES}$ of the lamp 306, and maintains the magnitude of the lamp current $I_L$ constant.

If the magnitude of the lamp voltage $V_L$ drops below the lower voltage threshold $V_{TH-LOW}$, the control circuit 360 may decrease the present intensity $L_{PRES}$ of the lamp 306 at the second fade rate (e.g., the post-lockout rate) as shown at time t3 in FIG. 5B. The control circuit 360 may decrease the present intensity $L_{PRES}$ until the present intensity reaches the target intensity $L_{TARGET}$ or the magnitude of the lamp voltage $V_L$ exceeds the upper voltage threshold $V_{TH-UP}$. The second fade rate may be slower than the first fade rate. For example, as illustrated in FIG. 5B, the second fade rate at which the control circuit 360 may decrease the present intensity $L_{PRES}$ of the lamp 306 may be approximately three times slower than the first fade rate. The second fade rate may be sized such that adjustment of the present intensity $L_{PRES}$ of the lamp 306 at the second fade rate is not visually perceptible to a user. When the magnitude of the lamp current $I_L$ reaches the target lamp current $I_{TARGET}$ (e.g., the low-end current ILE) at time t4, the control circuit 360 stops adjusting the lamp current $I_L$.

Figure 6:
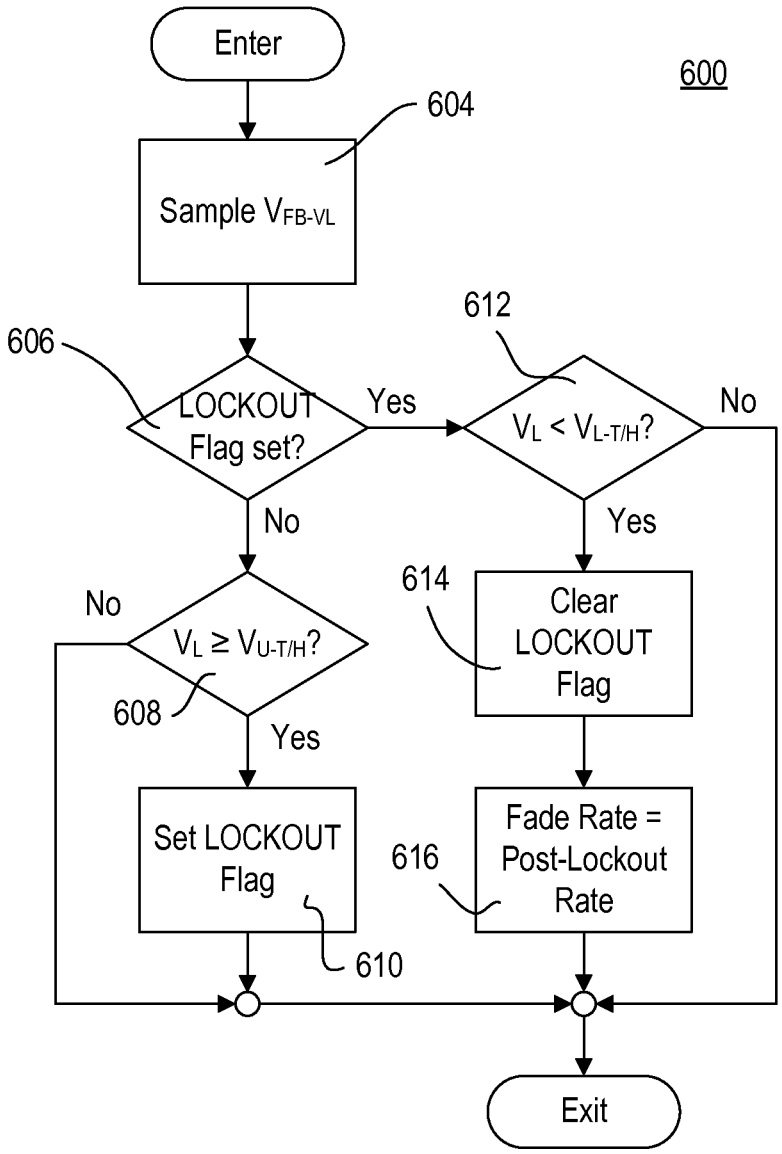
FIG. 6 is a simplified diagram of an example of a current-control lockout procedure executed by a control circuit of a ballast.

FIG. 6 is a simplified diagram of an example of a current-control lockout procedure 600, which may be executed by a control circuit of a ballast (e.g., the control circuit 360 of the ballast 300 as depicted in FIG. 3). The current-control lockout procedure 600 may begin when a lamp is first turned on and continue during normal operation of the ballast 300. For example, the current-control lockout procedure 600 may be executed periodically, for example, about every 104 microseconds.

The current-control lockout procedure 600 may run in concert with the current control routine that controls the present intensity $L_{PRES}$ of the lamp 306 to a desired intensity level (e.g., target intensity $L_{TARGET}$). For example, when the present intensity $L_{PRES}$ of the lamp 306 is adjusted (e.g., dimmed) to a low-end intensity $L_{LE}$ (e.g., at or near the minimum intensity of the lamp), the current control routine may cause the present intensity $L_{PRES}$ of the lamp to be decreased. The present intensity $L_{PRES}$ of the lamp 306 may be decreased by controlling (e.g., decreasing) the lamp current $I_L$ conducted through the lamp. The desired lamp level may be set by the user. In response, the current control routine may control the present intensity $L_{PRES}$ of the lamp 306 to the desired intensity level by adjusting the magnitude of the lamp current $I_L$ being conducted through the lamp. For example, when the lamp 306 is first struck (e.g., when the lamp is cold) and the desired lamp level is relatively low (e.g., below 15%), the current control routine may decrease the present intensity $I_{PRES}$ of the lamp at a relatively slow fade rate, for example, a fade rate equivalent to approximately a 30 second fade from 15% lamp current to 5% lamp current. Such a fade rate may be utilized because it may be slow enough that a human observer may not be able to notice that the lamp is actively dimming.

At 604, the control circuit 360 may sample (e.g., periodically sample) the lamp voltage feedback signal $V_{FB-VL}$. For example, as described herein, the lamp voltage feedback signal $V_{FB-VL}$ may be representative of the lamp voltage ($V_L$) and accordingly the lamp temperature $T_L$ of the lamp 306. At 606, the control circuit 360 may determine if the current control routine is presently locked, for example, by determining whether a LOCKOUT flag is set. For example, the adjustment of the lamp current $I_L$ by the current control routine may be stopped, and the LOCKOUT flag (e.g., a software variable, memory location, or the like) may indicate and/or cause the adjustment of the lamp current to stop.

If the LOCKOUT flag is not set, at 608, the control circuit 360 may determine (e.g., periodically determine) whether or not the magnitude of the lamp voltage $V_L$ is at or above the upper voltage threshold ($V_{TH-UP}$). The control circuit 360 may sample the lamp voltage feedback signal $V_{FB-VL}$ and determine whether or not the magnitude of the lamp voltage $V_L$ is at or above the upper voltage threshold $V_{TH-UP}$, for example, on a periodic basis or a substantially continuous basis.

If the magnitude of the lamp voltage $V_L$ is less than the upper voltage threshold $V_{TH-UP}$, then the control circuit 360, at 610, may set the LOCKOUT Flag. Setting the LOCKOUT flag may effectively stop the current control routine from adjusting the lamp current $I_L$. If the magnitude of the lamp voltage $V_L$ is not less than the upper voltage threshold $V_{TH-UP}$, then the current-control lockout procedure 600 may end. The current-control lockout procedure may run again at the next period (e.g., in 104 μsec), for example, as mentioned above. This decision point, at 608, and the corresponding action, at 610, may insure that the magnitude of the lamp voltage $V_L$ does not exceed the upper threshold voltage $V_{TH-UP}$, for example, as illustrated at 1022 and 1024 in FIG. 4.

When the LOCKOUT Flag is set, the control circuit 360 may determine, at 612, whether the magnitude of the lamp voltage $V_L$ is less than a lower voltage threshold $V_{TH-UP}$. If the magnitude of the lamp voltage $V_L$ is not less than a lower voltage threshold $V_{TH-UP}$, the current-control lockout procedure 600 may end. The current-control lockout procedure 600 may run again at the next period, for example, as mentioned above. If the magnitude of the lamp voltage $V_L$ is less than a lower voltage threshold $V_{TH-LOW}$, the LOCKOUT Flag may be cleared, at 614. This may, in effect, allow the control current routine begin adjusting the magnitude of the lamp current $I_L$ to control the magnitude of the lamp to the desired intensity level. For example, subsequent to stopping adjustment of the present intensity $L_{PRES}$ of the lamp 306, the control circuit 360 may begin to adjust the present intensity $L_{PRES}$ when the magnitude of the lamp voltage $V_L$ crosses the second threshold (e.g., the lower voltage threshold $V_L$-T/H). This subsequent adjustment, which may be a restarting of the current control routine, may correspond to 1023 and 1025 in the example illustrated in FIG. 4.

The current control routine may adjust the present intensity $L_{PRES}$ of the lamp 306 to the desired intensity level at one or more fade rates. These fade rates may determine how quickly the control loop drives the lamp to the desired intensity level. This process 600 may have two fade rates, for example, a pre-lockout fade rate and a post-lockout fade rate. Typically, the post-lockout fade rate may be slower than the pre-lockout fade rate. At about the time the LOCKOUT Flag is cleared, at 614, the operable fade rate may be the post-lockout fade rate. This action may be consistent with the two fade rates illustrated in FIG. 5B. The rates may be selected to ensure that the intensity of the lamp does not fade too quickly and cause the iteration to repeat and the lamp to oscillate.

Figure 7:
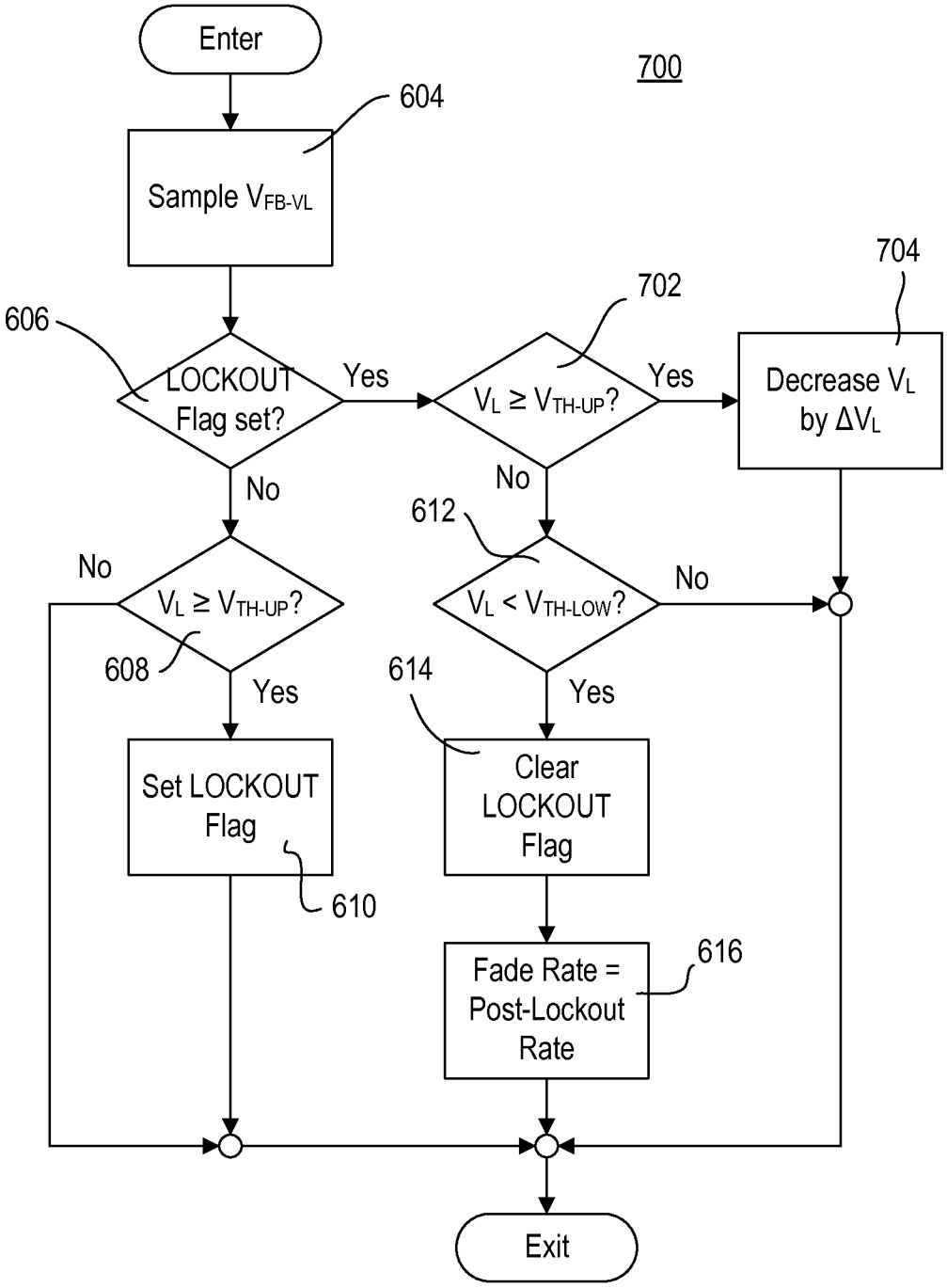
FIG. 7 is a simplified diagram of another example of a current-control lockout procedure executed by a control circuit of a ballast.

FIG. 7 is a simplified diagram of another example of a current-control lockout procedure 700 executed by a control circuit of a ballast (e.g., the control circuit 360 of the ballast 300 of FIG. 3). With regard to steps 604-616, the current-control lockout procedure 700 of FIG. 7 may operate, for example, as described herein with reference to current-control lockout procedure 600. When the LOCKOUT Flag is set, at 702, the control circuit 360 may determine (e.g., periodically determine) whether or not the magnitude of the lamp voltage $V_L$ is at or above the upper voltage threshold $V_{TH-UP}$. If the magnitude of the lamp voltage $V_L$ is at or above the upper voltage threshold $V_{TH-UP}$) at this point in the procedure, the control circuit 360 may decrease the magnitude of the lamp voltage $V_L$, for example, by an amount $\Delta V_L$. For example, the magnitude of the lamp voltage $V_L$ may be decreased by increasing the present intensity $L_{PRES}$ of the lamp 306 (i.e., by increasing the magnitude of the lamp current $I_L$). This additional action may serve to correct the magnitude of the lamp voltage $V_L$ in the event that the magnitude of the lamp voltage $V_L$ overshoots the upper voltage threshold $V_{TH-UP}$. If the magnitude of the lamp voltage $V_L$ is not at or above the upper voltage threshold $V_{TH-UP}$, the lamp voltage may be compared to the lower threshold, for example, at 612 as described herein. The amount $\Delta V_L$ may be a predetermined amount. The amount $\Delta V_L$ may be a dynamically determined amount, for example, an amount equal to the difference between the sampled lamp voltage and the upper threshold.

It should be understood that the current-control lockout procedures disclosed herein have been described in connection with electronic dimming ballasts and fluorescent lamps for illustrative purposes only. The processes described herein may be applied in other types of load control devices, such as, for example, light-emitting diode (LED) drivers for controlling LED light sources, as well as load control devices for controlling other types of high-efficacy light sources. In LED drivers, the lamp voltage across the LED light source may increase (e.g., increase drastically) when the LED light source is cold and the lamp current conducted through the LED light source is increasing. In this sense, the V-I curve for the LED light source may be generally flipped on the vertical axis and similarly shaped as those shown for ballasts in FIG. 4. It should also be understood that while the current-control lockout procedures disclosed herein have been described in regards to monitoring a magnitude of a lamp voltage of an electronic dimming ballast in order to control a lamp current conducted through a fluorescent lamp, the processes described herein may be applied to other measurable operating characteristics of an electronic dimming ballast, an LED driver, or other load control device.

A procedure, for example, may include adjusting the magnitude of a first operating characteristic of the electrical load and measuring the magnitude of a second operating characteristic of the electrical load. The second operating characteristic may be different than the first operating characteristic. For example, the first operating characteristic may include a load current conducted through the load, and the second operation the second operating characteristic may include a load voltage produced across the load.

If the magnitude of the second operating characteristic crosses a first threshold, adjustment of the magnitude of the first operating characteristic may be stopped. When the second operating characteristic crosses a second threshold, adjustment of the magnitude of the first operating characteristic may subsequently begin (e.g., restart following the stopping).

For gas discharge lamps, for example, the adjustment of the magnitude of the first operating characteristic may include decreasing the magnitude of the load current conducted through the load. Similarly, the subsequent beginning adjustment may include subsequently decreasing the magnitude of the load current.

For LED light sources, for example, the adjustment of the magnitude of the first operating characteristic may include increasing the magnitude of the load current conducted through the load. Similarly, the subsequent beginning adjustment may include subsequently increasing the magnitude of the load current.

The invention claimed is:

1. A load control device for controlling an amount of power delivered to an electrical load, the load control device comprising:
- a load current measurement circuit configured to generate a load current feedback signal representative of a magnitude of a load current conducted through the electrical load;
- a load voltage measurement circuit configured to generate a load voltage feedback signal representative of a magnitude of a load voltage produced across the electrical load;
- a control circuit configured to:
  - determine the magnitude of the load current conducted through the electrical load from the load current feedback signal;
  - adjust the magnitude of the load current conducted through the electrical load in response to the load voltage feedback signal;
  - determine the magnitude of a load voltage produced across the electrical load from the load voltage feedback signal;
  - limit adjustment of the magnitude of the load current conducted when the magnitude of the load voltage is greater than a first threshold; and
  - subsequently begin to adjust the magnitude of the load current when the magnitude of the load voltage is less than a second threshold.

2. The load control device of claim 1, further comprising:
- a load control circuit configured to control the magnitude of the load current conducted through the electrical load.

3. The load control device of claim 2, wherein the load control circuit comprises an inverter circuit configured to generate a high-frequency alternating-current (AC) voltage.

4. The load control device of claim 3, wherein the load control circuit comprises a resonant tank circuit configured to couple a high-frequency AC voltage to the electrical load.

5. The load control device of claim 1, wherein the control circuit is configured to decrease the magnitude of the load current, limit adjustment of the magnitude of the load current when the magnitude of the load voltage is greater than the first threshold, and subsequently decrease the magnitude of the load current when the magnitude of the load voltage is less than the second threshold.

6. The load control device of claim 5, wherein the electrical load comprises a gas discharge lamp and the load control device comprises an electronic dimming ballast.

7. The load control device of claim 1, wherein the control circuit is configured to increase the magnitude of the load current, limit adjustment of the magnitude of the load current when the magnitude of the load voltage is greater than the first threshold, and subsequently increase the magnitude of the load current when the magnitude of the load voltage is less than the second threshold.

8. The load control device of claim 7, wherein the electrical load comprises an LED light source and the load control device comprises an LED driver.

9. The load control device of claim 1, wherein the control circuit is configured to stop adjustment of a magnitude of the load current when the magnitude of the load voltage is greater than the first threshold.

10. The load control device of claim 1, wherein the control circuit is further configured to infer a temperature of the electrical load using the load voltage.

11. The load control device of claim 1, wherein the load current and the load voltage are measured internally to the load control device.

12. A method for controlling an amount of power delivered to an electrical load, the method comprising:

adjusting a magnitude of a load current conducted through the electrical load;

measuring a magnitude of a load voltage produced across the electrical load, the load voltage dependent on a temperature of the electrical load;

limiting the adjustment of the magnitude of the load current conducted through the electrical load when the magnitude of the load voltage is greater than a first threshold; and subsequently beginning to adjust the magnitude of the load current conducted through the electrical load when the magnitude of the load voltage is less than a second threshold.

13. The method of claim 12, wherein adjusting the magnitude of a load current comprises decreasing the magnitude of the load current; and wherein subsequently beginning to adjust the magnitude of the load current comprises subsequently decreasing the magnitude of the load current when the magnitude of the load voltage is less than the second threshold.

14. The method of claim 13, wherein the electrical load comprises a gas discharge lamp.

15. The method of claim 12, wherein adjusting the magnitude of a load current comprises increasing the magnitude of the load current; and wherein subsequently beginning to adjust the magnitude of the load current comprises subsequently increasing the magnitude of the load current when the magnitude of the load voltage is less than the second threshold.

16. The method of claim 15, wherein the electrical load comprises an LED light source.

17. The method of claim 12, further comprising:

determining the temperature of the electrical load using the load voltage.

18. The method of claim 12, wherein limiting the adjustment of the magnitude of the load current further comprises stopping the adjustment of the magnitude of the load current when the magnitude of the load voltage is greater than the first threshold.

* * * * *